United States Patent [19]

Compton

[11] 4,268,378

[45] May 19, 1981

[54] METHOD FOR REMOVING NITROGEN FROM SHALE OIL BY HYDROGENATION AND LIQUID SULFUR DIOXIDE EXTRACTION

[75] Inventor: Leslie E. Compton, Claremont, Calif.

[73] Assignee: Occidental Research Corporation, Irvine, Calif.

[21] Appl. No.: 138,559

[22] Filed: Apr. 8, 1980

Related U.S. Application Data

[63] Continuation of Ser. No. 55,285, Jul. 5, 1979, abandoned.

[51] Int. Cl.[3] ..... C10G 21/06

[52] U.S. Cl. ..... 208/254 R; 208/57; 208/96; 208/254 H; 208/338

[58] Field of Search ..... 208/254 H, 254 R, 57, 208/96, 108, 338

[56] References Cited

U.S. PATENT DOCUMENTS

| | | | |
|---|---|---|---|
| 1,710,200 | 4/1929 | Black et al. | 208/276 |
| 2,035,102 | 3/1936 | Stratford et al. | 208/324 |
| 2,035,583 | 3/1936 | Bailey | 546/181 |
| 3,025,230 | 3/1962 | MacLaren | 208/254 H |
| 3,052,742 | 9/1962 | Mills | 208/254 R |
| 3,085,061 | 4/1963 | Metrailer | 208/254 H |
| 3,719,588 | 3/1973 | Vernon et al. | 208/254 R |
| 3,825,488 | 7/1974 | Gatsis | 208/254 H |
| 3,836,453 | 9/1974 | Kovach et al. | 208/254 H |
| 4,071,435 | 1/1978 | Smith | 208/254 R |

*Primary Examiner*—Delbert E. Gantz
*Assistant Examiner*—G. E. Schmitkons
*Attorney, Agent, or Firm*—Christie, Parker & Hale

[57] ABSTRACT

A method is disclosed for reducing the nitrogen content of shale oil using mild hydrogenation followed by liquid sulfur dioxide extraction of the hydrogenated shale oil. The mild hydrogenation is effective for increasing the fraction of shale oil that is insoluble in the liquid sulfur dioxide. The mild hydrogenation is sufficient for saturating unsaturated compounds present in the shale oil to the substantial exclusion of adding hydrogen to the nitrogen of the nitrogen-containing compounds. Following hydrogenation of the shale oil, it is extracted with liquid sulfur dioxide at a temperature from about 14° F. to about 60° F. forming two fractions, a liquid sulfur dioxide insoluble fraction containing a relatively low nitrogen content and a liquid sulfur dioxide soluble fraction containing a relatively high nitrogen content. The liquid sulfur dioxide fraction is separated from the insoluble shale oil fraction. The liquid sulfur dioxide can be recovered for recycling to another extraction step.

14 Claims, 1 Drawing Figure

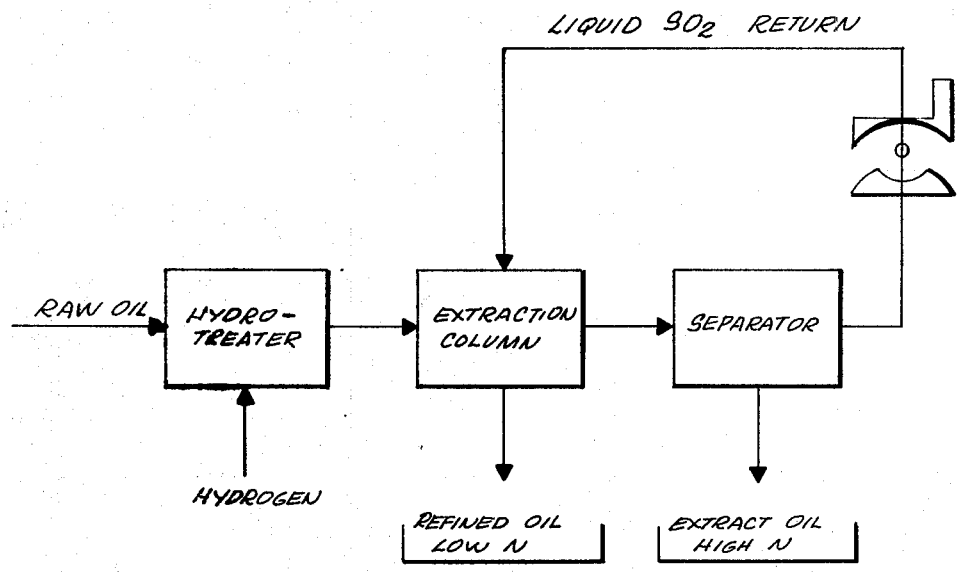
LIQUID SO2 RETURN
RAW OIL
HYDRO-TREATER
EXTRACTION COLUMN
SEPARATOR
HYDROGEN
REFINED OIL LOW N
EXTRACT OIL HIGH N

METHOD FOR REMOVING NITROGEN FROM SHALE OIL BY HYDROGENATION AND LIQUID SULFUR DIOXIDE EXTRACTION

CROSS REFERENCE TO RELATED APPLICATIONS

This is a continuation of application Ser. No. 055,285, filed July 5, 1979, now abandoned.

BACKGROUND OF THE INVENTION

The method herein relates to reducing the total nitrogen content of shale oil by hydrogenating the shale oil to saturate unsaturated hydrocarbons and extracting the resultant hydrogenated shale oil with liquid sulfur dioxide.

More particularly, this application relates to a method for reducing the nitrogen content of shale oil produced in an in situ oil shale retort.

The term "oil shale" as used in the industry is, in fact, a misnomer; it is neither shale nor does it contain oil. It is a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil."

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures of asphalts and bitumens.

Shale oils produced from oil shale are generally high molecular weight viscous organic liquids, predominantly hydrocarbonaceous or oxygen, nitrogen and sulfur containing organic compounds. The shale oils are of varying linear, branched, cyclic and aromatic hydrocarbon and substituted hydrocarbon content with high pour points, moderate sulfur content and relatively high nitrogen content. As the composition of shale oil depends upon the composition of the kerogen within the oil shale formation, the composition of the shale oil can vary from one geographic location to another. The shale oil produced from an oil shale formation can vary also between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, became oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation.

The nitrogen content in shale oil is attributable to basic nitrogen-containing compounds and nonbasic nitrogen-containing compounds. The relative percentages of the basic and nonbasic nitrogen compounds comprising the total nitrogen content of a shale oil can also vary depending upon the particular shale oil.

The nitrogen content of shale oil is generally up to about two percent by weight with shale oil from some deposits having greater than two percent by weight nitrogen content. The average nitrogen content of shale oil recovered by in situ retorting of oil shale from the Piceance Creek Basin of Western Colorado is about 1.4 percent by weight.

The presence of nitrogen in shale oil presents many problems in that the nitrogen can interfere with the transportation and use of the shale oil. Deleterious effects brought about by the presence of nitrogen in shale oil are decreased catalyst life in dehydrogenation, reforming, hydrocracking and catalytic cracking reactions, decreased chemical stability of products, and decreased color stability of products. Another problem with the presence of nitrogen in shale oil is that it is undesirable to transport nitrogen-containing shale oil through pipelines which are also used for transporting petroleum products because of possible pollution of such products with residual nitrogen-containing shale oil in the pipeline. Generally, such petroleum products have a very low nitrogen content. The relatively high nitrogen content in the shale oil can pollute the pipelines making them undesirable and uneconomical for transporting such low nitrogen-containing petroleum products. In addition, high nitrogen content in shale oil can cause decreased throughput of shale oil product in pipelines due to self-polymerization brought about by the reactivity of the nitrogen-containing compounds. Due to the basicity of the nitrogen-containing compounds in shale oil, some corrosion may occur, thus damaging a pipeline used to transport shale oil.

Product stability is a problem that is common to many products derived from shale oil with the major exception of the asphalt cut and those products that have undergone extensive hydrotreating. Such instability, including photosensitivity, is believed to be resultant, primarily from the presence of nitrogen-containing compounds.

It is, therefore, desirable to reduce the nitrogen content of shale oil to increase the utility, transportability, and stability of the shale oil and the products derived from such shale oil.

Due to the undesirable nature of nitrogen in organic fluid streams, such as fluid streams produced in the recovery and refining of petroleum, coal and oil shale, many processes have been developed to reduce the nitrogen content to an acceptable level. The level of acceptability for the nitrogen content is generally based upon the use of the particular stream.

U.S. Pat. No. 1,710,200 to Black et al. relates to a process for the treatment of hydrocarbon fractions obtained by distilling or thermocracking of hydrocarbon oils to remove sulfur-containing compounds from the fractions. The process is conducted by adding sulfuric acid and liquid sulfur dioxide to the fraction to be treated. The resulting raffinate possesses better stability with regard to color and storage.

U.S. Pat. No. 2,035,583 to Bailey discloses a process for the separation and recovery of nitrogen bases from mineral oils which include shale oils. In the process, the oil is extracted with a solvent for the nitrogen bases. Acceptable solvents include liquid sulfur dioxide, furfural, aniline, nitrobenzene and isobutyl alcohol. However, due to the solubility of desirable mineral oils, such as aromatics and olefins, the process also includes extracting the resultant extract with dilute aqueous acids to recover the nitrogen bases from the first extract. The nitrogen bases are then recovered from the aqueous solution by adding an inorganic base to precipitate the nitrogen bases.

U.S. Pat. No. 2,035,102 to Stratford et al. discloses a process for improving the color and viscosity of petroleum oils. In the process an oil is extracted with a selective solvent in combination with an acid. The selective solvent can be phenol, nitrobenzene, furfural or liquid sulfur dioxide. The acid is preferably an inorganic acid but can also be an organic acid such as picric, acetic, oxalic, citric and benzene sulfuric acids. Following the extraction, the resultant raffinate exhibits improved color stability.

U.S. Pat. No. 3,719,588 to Vernon et al. discloses a process for hydrotreating hydrocarbonaceous liquids to reduce the nitrogen and sulfur content therein. The process relates to the use of carbon monoxide in the hydrotreating process, wherein the carbon monoxide reacts with steam to provide the hydrogen for the process.

Many of the processes described in the above patents do not address themselves to the removal of nonbasic nitrogen compounds which can be present in organic fluids. Additionally, many of the above described processes are not specific for treatment of shale oil and the relatively high nitrogen content found in shale oil. Still further, none of the above processes are specific for lowering the nitrogen content of shale oil produced by in situ retoring of oil shale.

SUMMARY OF THE INVENTION

The present invention is directed to a method for the refining of shale oil wherein the shale oil is hydrogenated under mild hydrogenation conditions. The mild hydrogenation conditions are sufficient for saturating the unsaturated bonds present in the unsaturated compounds and, in particular, saturating the olefinic bonds in the shale oil to the substantial exclusion of adding hydrogen to the nitrogen of the nitrogen-containing compounds in the shale oil. That is, the hydrogenating conditions are sufficiently mild to substantially prevent hydrodenitrification of the shale oil. Mild hydrogenation conditions increase the amount of the shale oil that is insoluble in liquid sulfur dioxide. Conditions affecting hydrogenation include catalyst, temperature, residence time and hydrogen consumption. All of these conditions can be varied to produce acceptable mild hydrogenating conditions. Since all of their conditions can be varied and still provide mild hydrogenating conditions, the term mild hydrogenation is described relative to hydrogen consumption. In particular, hydrogen consumption is limited to up to about 500 standard cubic feet per barrel (scf/bbl) of shale oil.

Following hydrogenation, the hydrogenated shale oil is extracted with liquid sulfur dioxide. The sulfur dioxide extraction is conducted at a temperature from about 14° F. to about 60° F. The extraction of the hydrogenated shale oil with liquid sulfur dioxide produces two phases; a low nitrogen content liquid sulfur dioxide insoluble phase, and a high nitrogen content liquid sulfur dioxide soluble phase. The low nitrogen content insoluble phase comprises hydrocarbons which are essentially saturated, nonpolar compounds that are paraffinic or cycloparaffinic in nature.

The liquid sulfur dioxide soluble phase can be treated for the recovery of the sulfur dioxide and production of a relatively high nitrogen content residuum. The recovered sulfur dioxide can be recycled for use in an initial extraction step.

BRIEF DESCRIPTION OF THE DRAWING

The accompanying drawing is a flow chart illustrating the steps of the process herein described for reducing the nitrogen content of shale oil.

DETAILED DESCRIPTION OF THE INVENTION

This invention relates to the refining of shale oil and, more particularly, to the reducing of nitrogen content of shale oil.

As used herein, the term "crude shale oil" refers to the liquid product that is recovered from retorting of oil shale. The term encompasses liquid products formed during the retorting of oil shale either through aboveground retorting processes or in situ oil shale retorting processes which products have not undergone any further processing other than water removal or emulsion breaking. The term "processed shale oil" is used herein to indicate a crude shale oil which has undergone some processing, such as, for example, sulfur removal, fractionation and the like. As used herein, the term "refined shale oil" refers to a crude shale oil or a processed shale oil which has been processed through the method of this invention to reduce the nitrogen content of such shale oil. The "refined shale oil," therefore, has a lower nitrogen content than the crude shale oil or processed shale oil undergoing the method herein disclosed.

In a preferred practice of this method, the method is utilized for refining shale oil produced from in situ retorting of oil shale. An in situ oil shale retort can be formed by many methods, such as the methods disclosed in U.S. Pat. Nos. 3,661,423; 4,043,595; 4,043,596; 4,043,597; and 4,043,598, all of which are incorporated herein by this reference.

In preparing an in situ oil shale retort, formation from within the boundaries of a retort site is excavated to form at least one void, leaving a remaining portion of unfragmented formation within the boundaries of the retort being formed. The remaining portion of unfragmented formation is explosively expanded toward such a void to form a fragmented permeable mass of formation particles containing oil shale within the retort boundaries.

One method of forming an in situ oil shale retort is by excavating at least one columnar void, such as in the form of a vertical slot, for providing vertical free faces of formation on opposite sides of the slot in the retort site. Blasting holes are drilled in the unfragmented formation adjacent the vertical slot and parallel to such a free face. Explosive is loaded into the blasting holes and detonated to explosively expand formation adjacent the slot toward the vertical free faces to form a fragmented permeable mass of formation particles containing oil shale within the in situ retort being formed. Further details of techniques for forming a fragmented mass employing a columnar void are disclosed in aforementioned U.S. Pat. Nos. 4,043,595 and 4,043,596.

In another method of forming in situ oil shale retorts, the void excavated within the retort site can be a horizontal void for providing horizontal free faces of formation, toward which unfragmented formation within the retort site can be explosively expanded. After completion of the excavation of such horizontal void or voids, vertical blasting holes are drilled through the unfragmented formation remaining within the retort site. Explosive is placed into the blasting holes and subsequently detonated for explosively expanding the unfragmented formation toward the horizontal free faces. Further details of techniques for forming retorts using such horizontal voids are more fully described in the aforementioned U.S. Pat. Nos. 4,043,597 and 4,043,598.

After the fragmented mass is formed, the final preparation steps for producing liquid and gaseous products are carried out. These steps include drilling a plurality of feed gas inlet passages downwardly to the fragmented mass so that an oxygen-supplying gas can be supplied to the fragmented mass during retorting operations. Alternatively, the upper ends of blasting holes used in forming the fragmented mass can be cleaned and used for introducing gas to the retort. The fragmented mass connects to a product removal drift at the lower end of the fragmented mass.

During retorting operations, formation particles at the top of the fragmented mass are ignited to establish a combustion zone. An oxygen-supplying gas, such as air, is introduced to the combustion zone through the inlet passages. The oxygen-supplying gas introduced to the fragmented mass maintains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves downwardly through the fragmented mass, liquid and gaseous products are released from the fragmented formation particles. A sump in a portion of a drift connected to the lower end of the fragmented mass collects liquid products produced during operation of the retort. Off gas is also withdrawn through such drift to above ground.

Although the process disclosed herein of reducing the nitrogen content of shale oil is primarily discussed in relation to crude shale oil produced from the in situ retorting of oil shale, the process can be practiced on crude or processed shale oil produced by in situ retorting or by other methods of retorting. Many of these other methods for shale oil production are described in *Synthetic Fuels Data Handbook*, compiled by Dr. Thomas A. Hendrickson, and published by Cameron Engineers, Inc., Denver, Colo. For example, other processes for retorting oil shale include those known as the TOSCO, Paraho Direct, Paraho Indirect, N-T-U, and Bureau of Mines, Rock Springs, processes.

The TOSCO retorting process is described on pages 75 and 76 of the *Synthetic Fuels Data Handbook* and the U.S. patents mentioned therein, including U.S. Pat. No. 3,025,223. Generally speaking, this process involves preheating minus ½ inch oil shale to about 500° F. in a fluidized bed. Pyrolysis is completed in a rotating drum heated by ceramic balls which are separately heated in a ball-heating furnace.

The Paraho process is described at pages 62, 63, 84 and 85 of the *Synthetic Fuels Data Handbook* and the U.S. patents referred to therein. The Paraho process employs a vertical kiln through which comminuted oil shale moves downwardly as gas moves upwardly. Combustion air can be admitted into the bed of oil shale particles for direct heating of oil shale by combustion within the bed. This process is referred to as Paraho Direct. The kiln can also be arranged so that recycled gas can be heated externally, then injected into the bed of oil shale for indirect heating of the oil shale. Such a process is referred to as Paraho Indirect.

The N-T-U process is a batch process as described on page 59 of the *Synthetic Fuels Data Handbook* and the United States patents referred to therein. In the N-T-U process, a retort is filled with a batch of oil shale particles and ignited at the top. Combustion is supported by air injection and a combustion zone is passed downwardly through the stationary bed of shale. Recycled gas from the bottom of the retort is mixed with the combustion gas to modulate temperatures and provide some of the fuel requirement.

The Bureau of Mines, Rock Springs, process is described in the *Synthetic Fuels Data Handbook* and also in Paper No. SPE-6067 prepared for the 51st Annual Technical Conference and Exhibition of the Society of Petroleum Engineers of AIME, held in New Orleans, Oct. 3–6, 1976, by R. L. Wise, et al. Such a process is also described in U.S. Pat. No. 3,346,044, among others. Generally speaking, this process involves fracturing of an underground oil shale formation with the fractures propped open with sand. Injection and production wells are drilled into the formation. A combustion zone is moved from an injection well toward one or more production wells for retorting oil shale in the fractured formation.

A comparison of shale oils produced by various retorting processes on oil shale from the Piceance Creek Basin of Western Colorado discloses that molecular structure and weight distribution are not determined solely by the origin of the oil shale but are also influenced by parameters of the retorting process. The nitrogen content of the oil shale is a result of conditions and parameters which occurred during the time of the deposition of the material which formed the oil shale. The nitrogen in a particular oil shale formation is generally recovered in the crude shale oil following retorting of the oil shale. However, the manner in which this nitrogen content is bound in the shale oil, such as particular molecules and molecular weight thereof, is influenced by the conditions and parameters of the retorting process.

Crude shale oil can contain up to about 4 percent nitrogen, depending upon geographical location and conditions during deposition and lithification of the material forming the kerogen. Crude shale oil produced from the oil shale of the Piceance Creek Basin generally has a relatively high nitrogen content from about 0.5 to about 2 percent.

The crude shale oil produced from retorting an in situ oil shale retort contains a mixture of saturated and unsaturated hydrocarbons and aromatic hydrocarbons. The shale oil produced from in situ oil shale retorting is generally highly paraffinic with a fraction being aromatic or otherwise unsaturated.

Crude shale oil withdrawn from an in situ oil shale retort is, in the practice of the method herein, hydrogenated under mild hydrogenating conditions to reduce the unsaturated hydrocarbon content and increase the paraffinic content. Hydrogenation is conducted under mild conditions which are sufficiently mild to substantially prevent hydrogen addition to the nitrogen present in the nitrogen-containing compounds. The mild conditions are sufficient for adding hydrogen to the unsaturated sites and preferably the olefinic sites present in the shale oil. The hydrogenation step comprises heating the shale oil in the presence of a suitable hydrogenating catalyst and hydrogen for a time sufficient for saturating the unsaturated compounds present in the shale oil. There are four parameters which affect the hydrogenating conditions. These parameters are: (1) catalyst selection; (2) temperature; (3) hydrogen pressure; and (4) residence time in the hydrogenating zone. All of these parameters are variable and each can influence the hydrogenating conditions, that is, make the hydrogenation severe or mild. As there are many possible combinations and selections of these parameters which can provide the necessary mild hydrogenating conditions for effecting saturation without protonation of nitrogen, the hydrogenating conditions for the method herein are described functionally. After the selection of a catalyst, the temperature, hydrogen pressure and residence time are determined. When the catalyst has been selected, these other parameters can be determined empirically using the selected catalyst. Many catalysts can be selected for catalyzing the hydrogenation step. Hydrogenation catalysts, many of which are known in the art, can be used such as cobalt molybdate, nickel carbonyl, $Mo_2O_3$ on a suitable support such as alumina. Some such catalysts are commercially available such as Chevron Catalyst ICR-106, a product of Chevron Chemical Co. The other conditions can all vary independently. However, the temperature generally is selected from a temperature up to about 800° F. The hydrogen pressure is generally up to about 2000 psi and the residence time is expressed as space velocity (volume of shale oil fed/volume of catalyst fed/hour) is generally between about 0.3 and 2.

Generally, with in situ shale oil, the hydrogen consumption for saturating the unsaturated compounds without protonating the nitrogen is up to about 500 standard cubic feet (scf) per barrel of shale oil. In most hydrogenating steps herein, the hydrogen consumption is preferably up to about 500 scf per barrel of shale oil.

With higher hydrogen consumption, there occurs hydrogenation of aromatic compounds and protonation of nitrogen in the nitrogen-containing compounds. It is, therefore, preferred to minimize the addition of hydrogen to the aromatic and nitrogen containing compounds and to maximize hydrogenation of the olefinic compounds. Some hydrogen addition to the nitrogen can occur during mild hydrogenation because of the energy distribution among hydrogen atoms during hydrogenation. However, with mild hydrogenation conditions, as herein defined with regard to hydrogen consumption, such protonation of nitrogen is limited.

The hydrogenation step is preferably conducted using mild hydrogenating conditions such that hydrogen addition to the aromatic unsaturation present in shale oil does not occur. That is, the mild hydrogenation conditions are sufficiently mild to avoid saturating the aromatic compounds present.

The hydrogenating conditions, although mild, are generally sufficient to remove sulfur and oxygen-containing compounds from the shale oil. It is undesirable in most end uses of shale oil or in further processing steps, such as refining and cracking processes, to have sulfur present. The method herein for nitrogen removal utilizing a mild hydrogenating step is, therefore, also beneficial in reducing the sulfur and oxygen content.

The hydrogenation of the shale oil can be monitored to determine if sufficient hydrogenation is occurring to saturate substantially all of the olefinic compounds to the substantial exclusion of hydrogenating the aromatic compounds and nitrogen-containing compounds. When the nitrogen-containing compounds are being hydrogenated, a coking or solids generation can occur with capture of the solids by the catalyst. If coking of the catalysts is observed, then the hydrogenation conditions are too severe. Such coking and capture of the solids by the catalyst decreases the space velocity of the process stream through the catalyst due to plugging of the catalyst by the solids formed. If, therefore, a reduction in space velocity through the hydrogenation zone is observed, then the hydrogenating conditions are too severe.

Hydrogenation of shale oil to saturate the unsaturated compounds present follows first order kinetics. Therefore, for a shorter residence time in the catalyst hydrogenating zone, the temperature can be increased. If a longer residence time is desired, then the temperature of the hydrogenating zone can be lowered.

The reason for the hydrogenation step in the method herein is to increase the paraffinic content of the shale oil. It is preferable to increase the paraffinic content and reduce the olefinic content in order to reduce the loss of shale oil in the second step of the method herein which is liquid sulfur dioxide extraction. Generally, olefinic hydrocarbons are more soluble in liquid sulfur dioxide than are paraffinic hydrocarbons.

The liquid sulfur dioxide extraction step is conducted to remove nitrogen-containing compounds from the bulk of the shale oil. Liquid sulfur dioxide is a good solvent and extractant for the nitrogen-containing compounds and exhibits a stronger affinity for the nitrogen-containing compounds than the generally hydrocarbonaceous shale oil.

Generally, in a liquid sulfur dioxide extraction of shale oil, most of the components within the shale oil are soluble in the liquid sulfur dioxide with the exception of the paraffinic fraction of the shale oil. By mildly hydrogenating the shale oil, the paraffinic fraction is increased, increasing the fraction of the shale oil that is insoluble in liquid sulfur dioxide.

Extraction of the shale oil with liquid sulfur dioxide can be performed in batch extraction processes or can be conducted using continuous extraction techniques such as countercurrent extraction and cocurrent extraction techniques. In liquid phase batch extraction there can be employed a series of multi-stage batch extractions to improve overall efficiency of the extraction and to optimize nitrogen-containing compound removal. Similarly, continuous extraction can also be conducted utilizing continuous countercurrent or cocurrent extractors arranged in series to optimize the nitrogen-containing compound removal.

The amount of liquid sulfur dioxide that is required for extracting nitrogen-containing compounds from shale oil depends upon the nitrogen content in the shale oil and the solubility of such nitrogen-containing compounds in the liquid sulfur dioxide. The ratio of shale oil to liquid sulfur dioxide can be from about 0.20 to about 10 parts by weight shale oil to 1 part by weight liquid sulfur dioxide. Although a ratio less than 0.2:1 and greater than 10:1 can be used, it has been found beneficial to use the above range to minimize shale oil loss in the sulfur dioxide extract and to maximize nitrogen removal. Generally, a significant excess of liquid sulfur dioxide to shale oil is utilized to insure extraction of the nitrogen-containing compounds.

Along with nitrogen removal from the shale oil through extraction with the selective solvent, there is extraction of the other components, such as aromatics, sulfur-containing compounds, oxygen-containing compounds and other essentially non-paraffinic organic compounds, and there can be some loss of shale oil by the extraction procedure. For example, some of the shale oil that is paraffinic in nature can be carried away in the liquid sulfur dioxide extract following the separation because of inherent difficulty in performing precise liquid/liquid separation. The most efficient separation process is a process which removes the greatest amount of nitrogen-containing compounds with little accompanying valuable shale oil loss. The term "valuable shale oil" refers to the reduced nitrogen content shale oil that is substantially free of olefins. Separation efficiency can be determined by measuring the nitrogen concentration in the extract phase. Measuring the nitrogen concentration can also provide an indication of the amount of valuable shale oil that is also in the extract. The maximum amount of nitrogen in the extract from the method is limited by the total weight of the nitrogen-containing compounds in the shale oil and can be approached by preventing non-nitrogen-containing compounds from dissolving in the liquid sulfur dioxide. The earlier mild hydrogenation step reduces the amount of non-nitrogen-containing compounds that are soluble in the liquid sulfur dioxide.

The liquid sulfur dioxide extraction can be conducted at any temperature and pressure wherein sulfur dioxide is in liquid phase. When reducing the nitrogen content of crude shale oil by liquid sulfur dioxide extraction alone, it was determined that the extraction is conducted at about 14° F. (−10° C.) under atmospheric conditions or under elevated pressure for greatest efficiency and lowest valuable shale oil loss. Higher temperatures than 14° F. created greater liquid sulfur dioxide solubility of valuable components, i.e., olefins, in the shale oil other than the nitrogen-containing compounds. Such a low temperature for the extraction made the extraction process difficult as shale oil is highly viscous at such a temperature and tends to solidify, bottlenecking processing lines and reducing throughout.

The mild hydrogenation step decreases the olefinic content and raises the paraffinic content of shale oil. Paraffinic compounds are substantially insoluble in liquid sulfur dioxide and their limited solubility in liquid sulfur dioxide is not substantially affected by changes in temperature of the liquid sulfur dioxide.

After mildly hydrogenating crude shale oil as described herein, the resulting hydrogenated shale oil can be extracted at temperatures greater than 14° F. to increase the solubility of nitrogen-containing compounds in the liquid sulfur dioxide, thus increasing the efficiency of the nitrogen removal process without substantially decreasing valuable shale oil loss. Preferably, hydrogenated shale oil can be extracted at temperatures up to about 60° F. and more preferably up to about 50° F. at atmospheric pressure. Such temperatures prevent waxing (solidifying of low-melting compounds) of the shale oil and shale oil has a lower viscosity at such higher temperatures which facilitates the extraction process. Additionally, extraction at such temperatures does not, to any substantial degree, increase the amount of valuable shale oil lost in the extract as compared with extraction conducted at 14° F. Such temperatures also bring about a faster and more complete phase disengagement between the shale oil phase and the liquid sulfur dioxide phase.

Low temperature extractions of the hydrogenated shale oil can be enhanced by dewaxing the hydrogenated shale oil prior to performing the extraction. Dewaxing of the hydrogenated shale oil is referred to herein as a step which conditions the hydrogenated shale oil to remove the paraffins or otherwise inhibits the formation of low-melting solids by such paraffins. Acceptable dewaxing procedures include: (1) liquid propane extractions; (2) cooling and filtering; and (3) dual solvent treating. Liquid propane can be used as an extractant to extract the paraffins from the hydrogenated shale oil. The hydrogenated shale oil can be cooled until the paraffins solidify, then such waxy solids can be removed by filtration. In the dual solvent treatment, a solvent for the paraffins is employed, such as hexane, which helps maintain the paraffins in liquid form at such low temperatures during the liquid sulfur dioxide extraction. Such procedures inhibit the waxing of hydrogenated shale oil thereby enabling greater efficiency of low temperature liquid sulfur dioxide extraction which under some circumstances can be preferred because of the lower solvating activity of liquid sulfur dioxide at such lower temperatures.

The extraction process is conducted by combining the liquid sulfur dioxide extractant with either a hydrogenated crude or a hydrogenated processed shale oil. Extraction can be conducted in batchwise or continuous extraction such as cocurrent and countercurrent extraction techniques. The liquid sulfur dioxide and hydrogenated shale oil are thoroughly intermixed to provide the greatest opportunity for the nitrogen-containing compounds present in the shale oil to encounter the liquid sulfur dioxide. Such intermixing can be conducted, for example, by agitation in the batchwise and continuous extraction techniques or by the current flow in continuous extraction processes such as cocurrent and countercurrent extraction techniques.

Following the contact phase of the extraction process, the liquid sulfur dioxide extract phase is separated from the shale oil phase. The separation is possible due to the immiscibility of the liquid sulfur dioxide in shale oil. The immiscibility provides liquid/liquid phase formation whereupon one phase comprises substantially liquid sulfur dioxide, nitrogen-containing compounds and such other sulfur dioxide soluble compounds as aromatics, unsaturated olefinics and the like. The two phases are separated by decanting, withdrawing the lower phase or by other conventional liquid/liquid separation techniques. To facilitate complete separation of the two phases of the mixture, an emulsion breaker can be added to the mixture.

The nitrogen content of shale oil can be lowered by conducting successive extractions of the shale oil with liquid sulfur dioxide. Successive extractions can be conducted in the batchwise operation by separating the shale oil raffinate from the liquid sulfur dioxide extract pregnant with nitrogen-containing compounds after an initial extraction. The shale oil raffinate can then be extracted with non-pregnant liquid sulfur dioxide. Such successive extractions can be continued until the nitrogen content in the raffinate shale oil has been lowered to the desired level. Successive extractions can be conducted in continuous extraction operations by transferring the shale oil raffinate effluent from one extraction column into a second extraction column with or against the flow of liquid sulfur dioxide extractant.

After the pregnant liquid sulfur dioxide extract phase is separated from the shale oil raffinate having a reduced nitrogen content, the liquid sulfur dioxide can be recovered. The liquid sulfur dioxide is recovered by separating the sulfur dioxide from the nitrogen-containing compounds. For example, the sulfur dioxide can be volatilized from the extract phase such as by reducing the pressure on the extract. The volatilized sulfur dioxide can be reliquefied for recycling to another extraction step.

The extract phase containing a relatively high nitrogen content after sulfur dioxide separation can be treated for recovery of nitrogen values contained therein. For example, some of the nitrogen-containing compounds that are basic can be precipitated from the extract phase by addding a stronger base or the nitrogen-containing compounds can be extracted from the extract phase in another extraction process utilizing a suitable extractant for the nitrogen-containing compounds, such as a strong acid for the basic nitrogen-containing compounds.

The extract phase after liquid sulfur dioxide separation can be useful because of its high nitrogen content. For example, the extract can be used in the production of nitrogen compounds and various chemical intermediates containing nitrogen. After the liquid sulfur dioxide is volatilized, the residue can be used as an asphalt which provides good adhesive properties because of its nitrogen content and capacity to form cross-links through such nitrogen.

The accompanying drawing illustrates a flow diagram for the method described herein. With reference to the drawing, a shale oil feed is introduced into a conventional hydrotreater wherein mild hydrogenation to saturate the olefinic compounds occurs. The hydrotreater comprises a suitable hydrogenation catalyst, means for introducing hydrogen, and heating means for controlling the temperature of a hydrogenation zone within the hydrotreater.

After passing through the hydrogenation zone in the hydrotreater, the partially hydrogenated shale oil is extracted in an extraction column with liquid sulfur dioxide. The resulting two-phase system is separated, producing a lowered nitrogen content, refined shale oil fraction, and a high nitrogen content liquid sulfur dioxide fraction. The refined shale oil fraction can be further used for recovery of values therein in subsequent processes such as cracking and the like. The liquid sulfur dioxide fraction is recovered and transferred to a sulfur dioxide separator wherein sulfur dioxide is recovered and a nitrogen-rich oil fraction is produced. The recovered sulfur dioxide can be recycled to extract additional hydrogenated shale oil. If the sulfur dioxide is recovered as a gas, it can be repressurized to a liquid prior to recycling.

The following examples and comparative example illustrate the method herein described for reducing the nitrogen content of shale oil.

COMPARATIVE EXAMPLE 1

A crude shale oil produced by in situ retorting of oil shale is treated for lowering the nitrogen content therein. The shale oil has an initial nitrogen content of about 1.55 percent by weight.

The crude shale oil is extracted with liquid sulfur dioxide at a temperature of about 14° F. The low temperature extraction is conducted to minimize valuable shale oil loss in the liquid sulfur dioxide extract. After phase separation, there is obtained a liquid sulfur dioxide insoluble shale oil fraction having a reduced nitrogen content. This insoluble fraction comprises about $\frac{1}{2}$ to about $\frac{5}{8}$ of the initial shale oil. The insoluble fraction has a nitrogen content of about 1 percent by weight which is a reduction of about 35.5 percent of the initial nitrogen content.

The liquid sulfur dioxide soluble fraction comprises from about $\frac{3}{8}$ to about $\frac{1}{2}$ of the initial shale oil. The soluble fraction has a nitrogen content of about 2.4 percent by weight.

EXAMPLE 2

A crude shale oil produced by in situ retorting of oil shale is treated for reducing the nitrogen content therein. The shale oil has an initial nitrogen content of about 1.55 percent by weight.

The crude shale oil is hydrogenated under mild hydrogenating conditions to saturate the olefinic compounds present to the substantial exclusion of protonating nitrogen present in the shale oil. Hydrogen consumption during the mild hydrogenation is about 300 standard cubic feet per barrel of crude shale oil.

The hydrogenated shale oil is extracted with liquid sulfur dioxide at about 50° F. to extract nitrogen-containing compounds. Upon extraction there are formed two phases, a liquid sulfur dioxide soluble phase and a liquid sulfur dioxide insoluble phase.

The liquid sulfur dioxide insoluble phase comprises about $\frac{3}{4}$ of the initial shale oil. This fraction of the shale oil has a nitrogen content of about 0.67 to about 0.8 percent by weight.

The liquid sulfur dioxide soluble phase comprises about $\frac{1}{4}$ of the initial shale oil after separation of the sulfur dioxide. This fraction has a nitrogen content of about 4 percent by weight.

EXAMPLE 3

A shale oil produced by in situ retorting of oil shale is treated to reduce the nitrogen content therein. The initial shale oil has a nitrogen content of about 1.55 percent by weight.

The shale oil is hydrogenated over a cobalt molybdate hydrogenation catalyst supported on an alumina support. The temperature of the hydrogenation zone is about 700° F. and, hydrogen pressure is maintained at about 600 psig. The residence time of the reactants within the hydrogenation zone is defined in terms of the space velocity of the reactants through the hydrogenation zone. The space velocity (volume of shale oil fed/volume of catalyst fed/hour) is about 0.5 There is about 500 scf of hydrogen consumed per barrel of shale oil.

The hydrogenated shale oil is extracted with liquid sulfur dioxide at about 50° F. The liquid sulfur dioxide insoluble phase has a nitrogen content of about 0.7 percent by weight.

The liquid sulfur dioxide phase is treated for recovery of sulfur dioxide. The sulfur dioxide is volatilized and separated. The volatilized sulfur dioxide is reliquefied by pressurization.

EXAMPLES 4–8

A shale oil, having a nitrogen content of about 1.36 percent by weight and produced by in situ retorting of oil shale, was treated for reducing the nitrogen content.

The shale oil was hydrogenated in the presence of a nickel-molybdenum-on alumina hydrogenation catalyst commercially available from American Cyanamid s AERO HDS-9A catalyst. The catalyst, 50 g, was added to a reactor in its oxide form and activated by sulfiding with 5 percent $H_2S$ in $H_2$ gas mixture at a flow rate of 100 cc/min for 2 hours at 400° F., 1 hour at 500° F. and 1 hour at 600° F. The reactor was pressurized with hydrogen to 1500 psi. Shale oil was pumped into the reactor for subsequent hydrogenation.

The following table lists the parameters of the hydrogenation and results.

| Example | 4 | 5 | 6 | 7 | 8 |
|---|---|---|---|---|---|
| Time, hrs. | 12.1–14.0 | 27.0–28.0 | 30.0–31.6 | 32.9–34.0 | 28.6–30.0 |
| P, psi | 1500 | 1500 | 1000 | 1000 | 2000 |
| T, °F. | 600 | 500 | 500 | 600 | 500 |
| WHSV* | 4.5 | 2.4 | 2.4 | 2.4 | 2.4 |
| $H_2$ Consumption scf/bbl | 367 | 190 | 144 | 266 | 129 |
| H/C Increase | 0.067 | 0.032 | 0.024 | 0.047 | 0.021 |
| N Content Weight % | 1.30 | 1.24 | 1.23 | 1.20 | 1.32 |

*Weight hourly space velocity $= \frac{\text{wt. of oil fed per hour}}{\text{wt. of catalyst}}$, hour$^{-1}$ The resulting hydrogenated shale oil is extracted with liquid sulfur dioxide to separate the nitrogen-containing compounds from the hydrogenated shale oil. The liquid sulfur dioxide phase is separated from the liquid sulfur dioxide insoluble phase. The recovered liquid sulfur dioxide insoluble shale oil for the examples contains about 0.6 to about 0.7 percent by weight nitrogen.

What is claimed is:

1. A method for reducing the nitrogen content of shale oil comprising the steps of:

hydrogenating a shale oil having a first nitrogen content under conditions for effecting saturation of substantially all olefinic hydrocarbons present in the shale oil without substantially hydrogenating the nitrogen-containing compounds present in the shale oil;

extracting the hydrogenated shale oil with liquid sulfur dioxide for forming a shale oil phase having a second nitrogen content less than the first nitrogen content of the unhydrogenated shale oil and a liquid sulfur dioxide phase containing nitrogen-containing compounds; and separating the shale oil phase having a second nitrogen content from the liquid sulfur dioxide phase.

2. A method as recited in claim 1 wherein the hydrogenating conditions comprise hydrogen consumption of up to about 500 scf of hydrogen per barrel of shale oil.

3. A method as recited in claim 1 wherein the hydrogenating conditions comprise hydrogen consumption of up to about 300 scf of hydrogen per barrel of shale oil.

4. A method as recited in claim 1 wherein the extraction step with liquid sulfur dioxide is conducted from about 14° F. to about 60° F.

5. A method as recited in claim 1 further comprising, after separating the liquid sulfur dioxide phase from the shale oil phase, the steps of volatilizing the sulfur dioxide from the liquid sulfur dioxide phase; recovering and reliquifying the sulfur dioxide; and recycling the liquid sulfur dioxide for extracting hydrogenated shale oil.

6. A method as recited in claim 1 wherein the hydrogenating conditions are sufficient for saturating substantially all of the olefinic double bonds present in the shale oil to the substantial exclusion of saturating aromatic double bonds present in the shale oil.

7. A method as recited in claim 1 wherein the liquid sulfur dioxide extraction is conducted using from about 0.20 to about 10 parts by weight shale oil to 1 part by weight liquid sulfur dioxide.

8. A method for reducing the nitrogen content of shale oil produced by retorting of oil shale in an in situ retort containing a fragmented permeable mass of formation particles containing oil shale by advancing a processing zone through such fragmented mass to produce such shale oil, the method comprising the steps of:

hydrogenating a shale oil having a first nitrogen content in a hydrogenation zone under conditions for effecting saturation of olefinic compounds present in the shale oil to the substantial exclusion of protonating nitrogen-containing compounds present in the shale oil;

extracting the hydrogenated shale oil with liquid sulfur dioxide for forming a shale oil phase having a second nitrogen content less than the first nitrogen content of the unhydrogenated shale oil and a liquid sulfur dioxide phase containing nitrogen-containing compounds; and separating the shale oil phase having a second nitrogen content from the liquid sulfur dioxide phase.

9. A method as recited in claim 8 wherein the hydrogenating conditions comprise hydrogen consumption of up to about 500 scf of hydrogen per barrel of shale oil.

10. A method as recited in claim 8 wherein the hydrogenating conditions comprise hydrogen consumption of up to about 300 scf of hydrogen per barrel of shale oil.

11. A method as recited in claim 8 wherein the extraction step with liquid sulfur dioxide is conducted from about 14° F. to about 60° F.

12. A method as recited in claim 8 further comprising, after separating the liquid sulfur dioxide phase from the shale oil phase, the steps of volatilizing the sulfur dioxide from the liquid sulfur dioxide phase; recovering the volatilized sulfur dioxide; reliquifying the sulfur dioxide; and recycling the recovered, liquid sulfur dioxide to an extracting step.

13. A method as recited in claim 8 wherein the hydrogenating conditions are sufficient for saturating substantially all of the olefinic double bonds present in the shale oil to the substantial exclusion of saturating the aromatic double bonds present in the shale oil.

14. A method as recited in claim 8 wherein the liquid sulfur dioxide extraction is conducted using from about 0.20 to about 10 parts by weight shale oil to 1 part by weight liquid sulfur dioxide.

* * * * *